US006866338B2

(12) United States Patent
Mendenhall et al.

(10) Patent No.: US 6,866,338 B2
(45) Date of Patent: Mar. 15, 2005

(54) CHAIR STACKER APPARATUS

(75) Inventors: Andrew B. Mendenhall, Indianapolis, IN (US); Jason S. Andrews, Indianapolis, IN (US); Dennis M. Turner, Mooresville, IN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/621,495

(22) Filed: Jul. 17, 2003

(65) Prior Publication Data

US 2005/0012369 A1 Jan. 20, 2005

(51) Int. Cl.[7] ..... A47C 3/04

(52) U.S. Cl. ..... 297/239; 297/248; 297/249; 297/463.1; 248/345.1; 16/42 T; 16/42 R; 16/18 CG

(58) Field of Search ..... 297/239, 248, 297/249, 463.1, 463.2; 248/345.1; 16/42 T, 42 R, 18 CG

(56) References Cited

U.S. PATENT DOCUMENTS

| | | | | | |
|---|---|---|---|---|---|
| 2,807,042 | A | * | 9/1957 | Cramer | 16/42 R |
| 2,956,618 | A | | 10/1960 | Eames et al. | |
| 3,025,105 | A | | 3/1962 | Nash | |
| 3,084,977 | A | | 4/1963 | Chapman | |
| 3,095,236 | A | * | 6/1963 | Klassen | 297/239 |
| 3,133,762 | A | | 5/1964 | Newman | |
| 3,144,271 | A | | 8/1964 | Lieberman et al. | |
| 3,183,034 | A | | 5/1965 | Midyette, Jr. | |
| 3,246,928 | A | * | 4/1966 | Haynes et al. | 297/239 |
| 3,291,523 | A | | 12/1966 | Krueger | |
| 3,328,075 | A | | 6/1967 | Albinson | |
| 3,351,378 | A | | 11/1967 | Bliss | |
| 3,365,233 | A | | 1/1968 | Uyeda et al. | |
| 3,402,963 | A | | 9/1968 | Fujioka et al. | |
| 3,610,686 | A | | 10/1971 | Caruso | |
| 3,637,256 | A | | 1/1972 | Harty | |
| 3,695,694 | A | | 10/1972 | Mohr | |
| 3,697,130 | A | | 10/1972 | Barecki et al. | |
| 3,708,202 | A | * | 1/1973 | Barecki et al. | 297/239 |
| 3,755,853 | A | * | 9/1973 | Barile | 169/42 R |
| 3,758,155 | A | | 9/1973 | Straits | |
| 3,826,453 | A | | 7/1974 | Hitchcock | |
| 3,847,433 | A | | 11/1974 | Acton et al. | |
| 4,386,804 | A | | 6/1983 | Ware et al. | |
| 4,400,031 | A | | 8/1983 | DeDecker | |
| 5,002,337 | A | | 3/1991 | Engel et al. | |
| 5,010,621 | A | * | 4/1991 | Bock | 16/39 |
| 5,154,474 | A | | 10/1992 | Desanta | |
| 5,863,096 | A | | 1/1999 | Bartlmae | |
| 6,219,882 | B1 | * | 4/2001 | Olson | 16/42 R |
| 6,338,528 | B1 | | 1/2002 | Lohness et al. | |

* cited by examiner

*Primary Examiner*—Laurie K. Cranmer
(74) *Attorney, Agent, or Firm*—Barnes & Thornburg LLP

(57) ABSTRACT

A chair includes a seat and a seat frame including several legs. Bumpers are coupled to the legs and arranged to separate one chair from an underlying chair in a stack of chairs.

23 Claims, 5 Drawing Sheets

CHAIR STACKER APPARATUS

BACKGROUND AND SUMMARY

The present disclosure relates to chairs, and particularly to stackable and gangable chairs. More particularly, the present disclosure relates to apparatus for stacking chairs.

Some chairs are configured to be stacked on top of one another to conserve storage space. The legs of stackable chairs can be marred or scratch inadvertently if the legs of one chair are allowed to contact the legs of another chair in a stack of chairs.

According to the present disclosure, a chair includes a seat and a seat frame including several legs. Bumpers are coupled to the legs and arranged to separate the legs of the chair from the legs of an underlying chair in a stack of chairs.

In an illustrative embodiment, a leg cap including a guide bumper is coupled to a lower end of each leg. A stacker bumper is coupled to an upper end of each leg; The guide and stacker bumpers on each leg are adapted to engage a companion adjacent leg of the underlying chair to maintain those legs in spaced-apart parallel relation to one another when the chair is stacked on the underlying chair to facilitate creation of an upright vertical stack of chairs.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
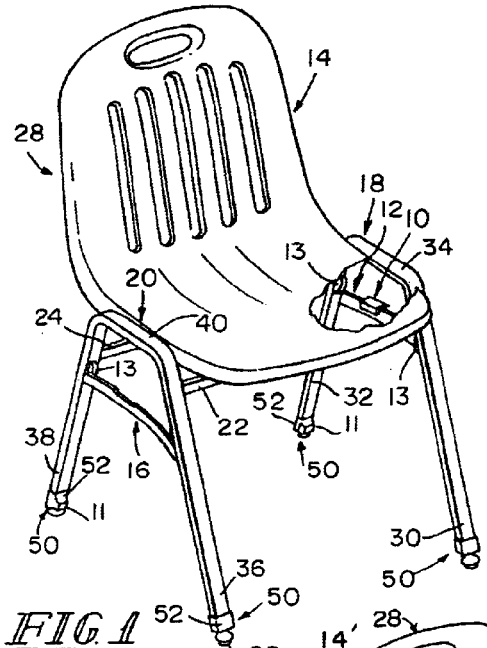
FIG. 1 is a perspective view of a first chair according to this disclosure showing a leg cap mounted on the lower end of each chair leg and formed to include a "guide" bumper and showing a "stacker" bumper mounted near the upper end of each chair leg in a location just above a cross bar.
Figure 2:
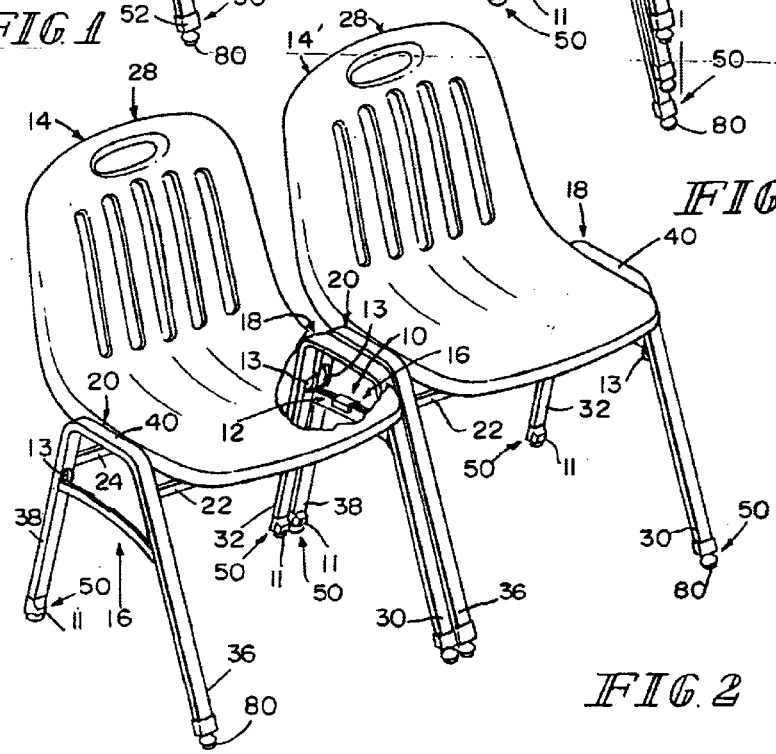
FIG. 2 is a perspective view similar to FIG. 1 showing two chairs of the type shown in FIG. 1 wherein a gang flange on the left chair is mated with a gangflange receiver channel on the right chair to link the two chairs together in side-byside "ganged" relation.

A gang flange 10 is coupled to a first cross bar 12 included in a chair 14 as shown in FIG. 1. Chair 14 also includes a second cross bar 16 arranged to lie in spaced-apart relation to first cross bar 12. Gang flange 10 on chair 14 is arranged and configured to mate with a second cross bar 16 on an adjacent chair 14' to "gang" chairs 14 and 14' together as shown, for example, in FIG. 2. Using gang flange 10, chairs 14 and 14' can be ganged to one another (as suggested in FIGS. 2 and 6) or stacked on one another (as shown in FIG. 3) easily.

Figure 3:
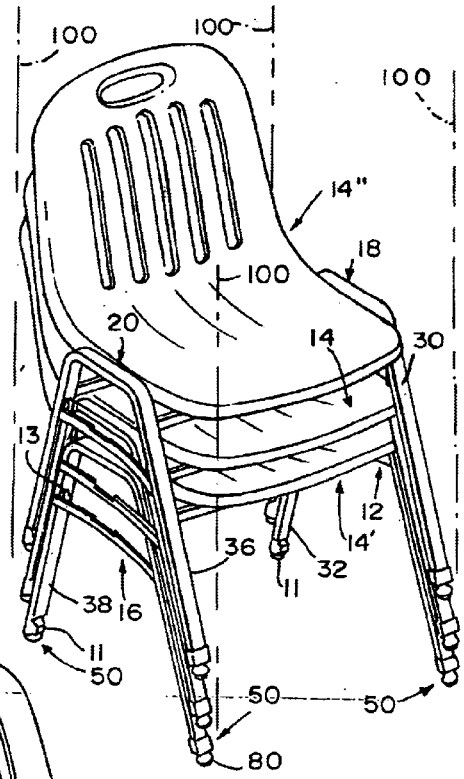
FIG. 3 is a perspective view similar to FIG. 1 showing three chairs of the type shown in FIG. 1 wherein the chairs are stacked vertically and the guide and stacker bumpers on each chair cooperate with the legs of an underlying chair to "separate" one chair from another when stacked as shown in a vertical stack to prevent marring or scratching of the chair legs.

Chairs 14, 14', and 14" are also configured to be stacked as shown, for example, in FIGS. 3 and 14. Guide bumpers 11 and stacker bumpers 13 are provided to separate one chair from another when the chairs are stacked for storage.

Figure 4:
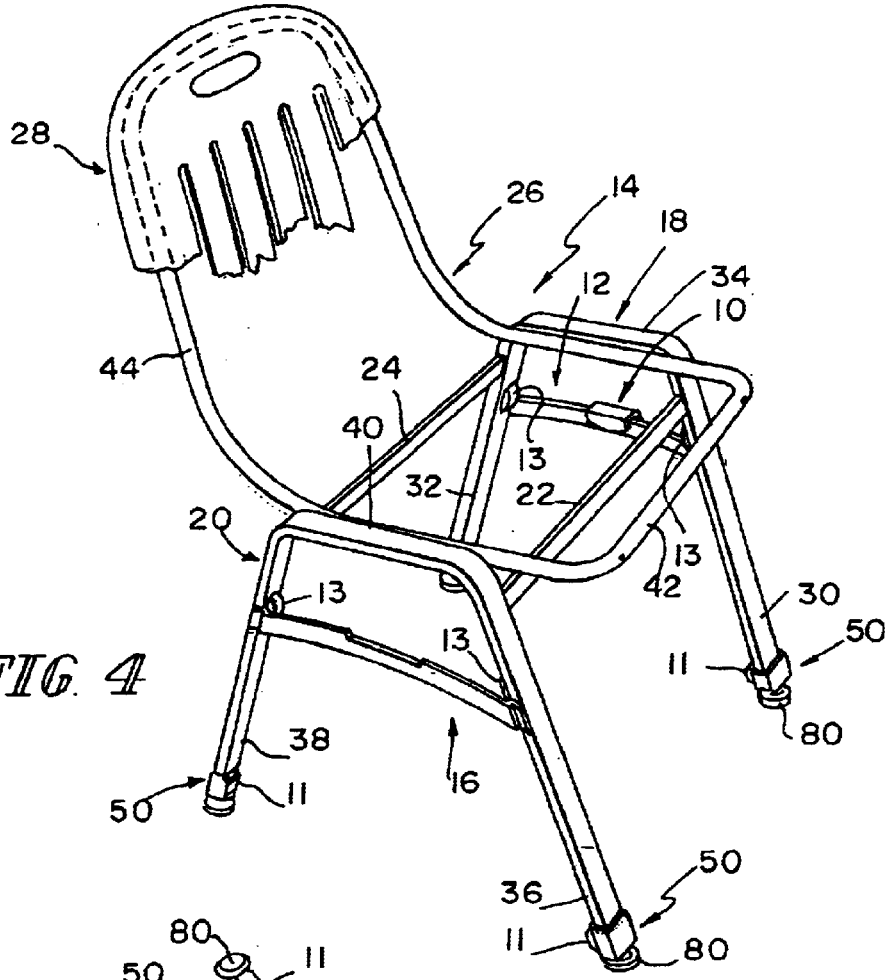
FIG. 4 is a perspective view of the chair of FIG. 1 with a portion of the seat shell removed to show first and second leg units, front and rear frame mounts extending between the first and second leg units, and a tubular shell support frame mounted to the first and second leg units and arranged to lie under the seat shell.
Figure 5:
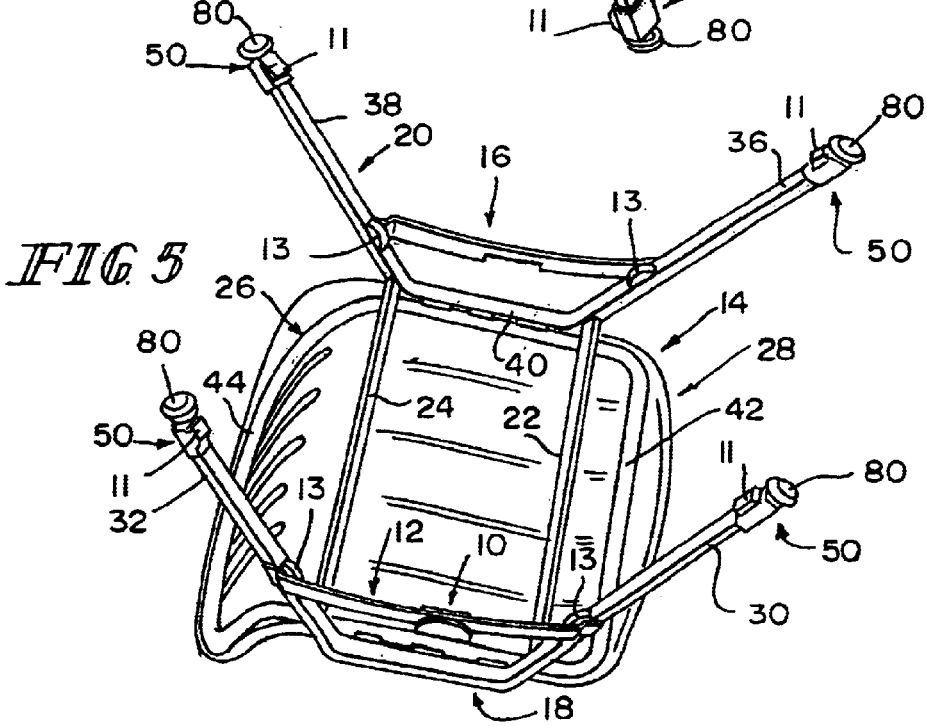
FIG. 5 is a view of the chair shown in FIGS. 1 and 4 after the chair has been inverted to show the underside of the seat shell and the four guide bumpers and four stacker bumpers.

Chair 14 includes a first leg unit 18 carrying two guide bumpers 11, first cross bar 12, and two stacker bumpers 13 (as shown, for example, in FIGS. 1, 4, and 5). Chair 14 also includes a second leg unit 20 carrying two more guide bumpers 11, second cross bar 16, and two more stacker bumpers l3. Front and rear frame members 22, 24 are also included in chair 14. A shell-support frame 26 is coupled to each of first and second leg units 18, 20 and configured to support seat shell 28 as shown, for example, in FIGS. 1, 4, and 5.

First leg unit 18 includes front leg 30, rear leg 32, and first leg connector 34 arranged to interconnect front and rear legs 30, 32. A guide bumper 11 and a stacker bumper 13 is associated with each of front and rear legs 30, 32. Second leg unit 20. includes front leg 36, rear leg 38, and second leg connector 40 arranged to interconnect front and rear legs 36, 38. A guide bumper 11 and a stacker bumper 13 is associated with each of the front and rear legs 36, 38.

Shell-support frame 26 includes a lower U-shaped portion 42 coupled to first and second leg units 18, 20 using any suitable means. Frame 26 also includes an upper U-shaped portion 44 coupled to lower U-shaped portion 42 as suggested in FIGS. 4 and 5. In the illustrated embodiment, an endless tubular member is used to define shell-support frame 26. Seat shell 28 is coupled to shell-support frame 26 using any suitable means.

As suggested in FIGS. 1, 4, and 5, chair 14 includes four leg caps 50 and a leg cap 50 is associated with each of legs 30, 32, 36, and 38. Each leg cap 50 includes a leg sleeve 52 formed to include a leg receiver 54 and a guide bumper 11 coupled to leg sleeve 52 as shown, for example, in FIGS. 6 and 7.

A lower end 56 of each of legs 30, 32, 36, and 38 extends into one of the leg receivers 54 as suggested in FIGS. 4 and 5 to couple each leg to one of the leg caps 50. Each guide bumper 11 is arranged to lie in spaced-apart relation to the lower end 56 of a companion chair leg 30, 32, 36, or 38. That arrangement is shown, for example, in FIG. 7.

Figure 6:
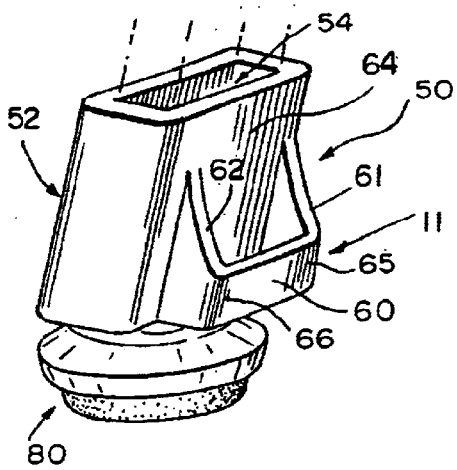
FIG. 6 is an enlarged perspective view of one of the leg caps mounted on the lower ends of the chair legs showing a leg sleeve adapted to be mounted on a chair leg and a guide bumper appended to the leg sleeve.
Figure 7:
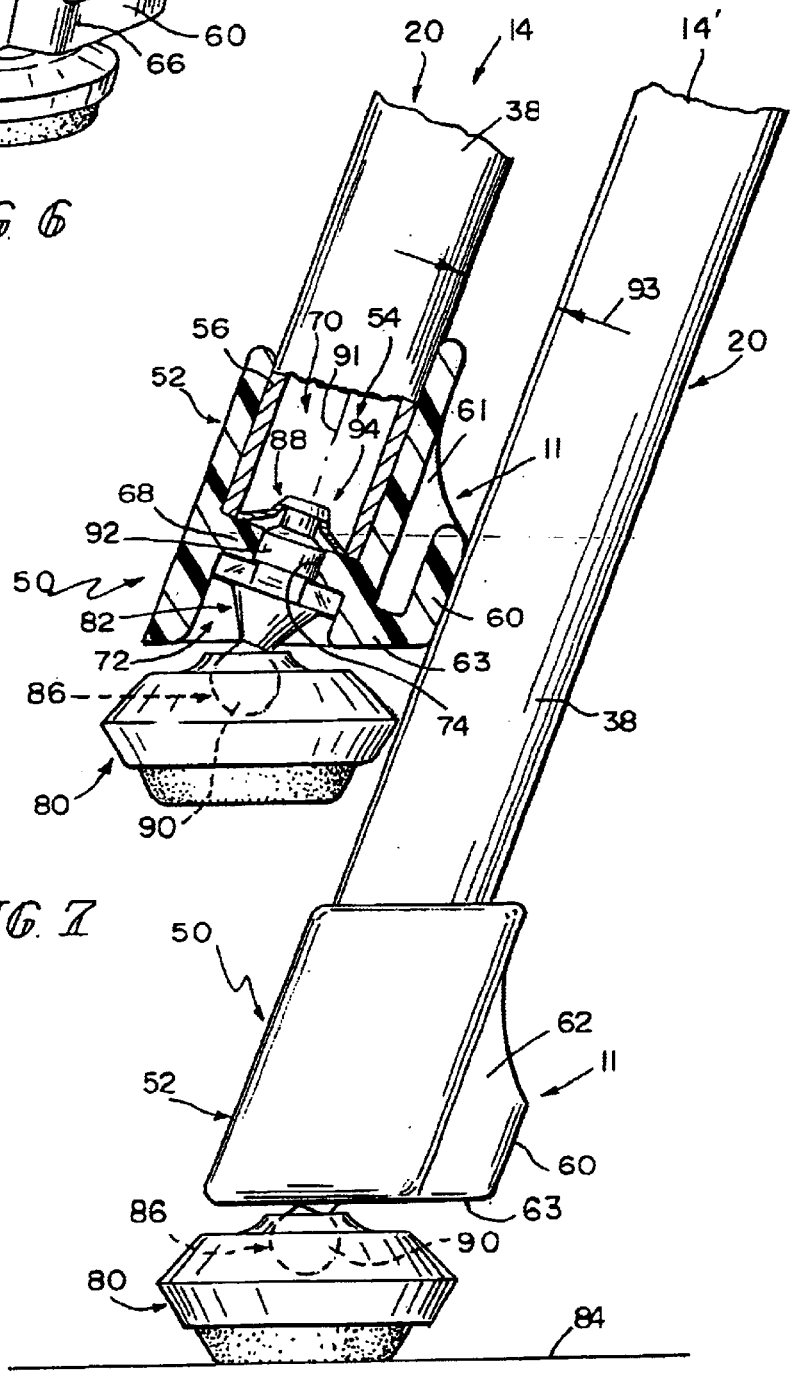
FIG. 7 is an enlarged view of two chair legs (as shown in FIG. 3) maintained in spaced-apart parallel relation to one another by the guide member included in the leg cap (in section) of the higher chair leg and showing a foot leveler passing through a throat formed in an anchor plate included in the leg cap to couple a foot to the chair leg.

Guide bumper 11 includes a leg pad 60, first and second pad supports 61, 62, and a floor 63 as shown, for example, in FIGS. 6 and 7. Each of pad supports 61, 62 is coupled to an exterior surface 64 of leg sleeve 52 and is arranged to hold leg pad 60 in a fixed, spaced-apart position relative to leg sleeve 52.

In the illustrated embodiment, first pad support 61 is coupled to a first end 65 of leg pad 60 and second pad support 62 is coupled to a second end 66 of leg pad 60. First and second pad supports 61, 62 are arranged to lie in spaced-apart parallel relation to one another. Each pad support 61, 62 is arranged to lie in perpendicular relation to leg pad 60 and to exterior surface 64 of leg sleeve 52. Guide bumper 11 has a U-shaped cross section established by leg pad 60 and first and second pad supports 61, 62 as suggested in FIG. 6.

An anchor plate 68 is located in leg receiver 54 of leg sleeve 52 as shown, for example, in FIG. 7. Anchor plate 68 cooperates with leg sleeve 52 to define an upper chamber 70 in leg receiver 54 sized to receive the lower end 56 of a chair leg and to define a downwardly opening lower chamber 72. Anchor plate 68 is formed to include a throat 74 providing a passage interconnecting upper and lower chambers 70, 72.

A foot 80 is coupled to each of the leg caps 50 in the illustrated embodiment using a foot leveler 82 as suggested in FIG. 7 to allow limited movement of foot 80 relative to leg cap 50. Foot 80 and foot leveler 82 cooperate to establish a "floor engager" adapted to engage a floor 84 underlying anchor plate 62 to support seat frame 18, 20, 22, 24 in a position above floor 84. Although an articulated floor engager is illustrated, it is within the scope of this disclosure to mount a nonarticulated floor engager to leg cap 50.

As suggested in FIG. 7, foot 80 is formed to include a socket 86. Foot leveler 82 includes a mount 88 retained on anchor plate 68 and a ball 90 coupled to mount 88 for movement in socket 86 to allow movement of foot 80 relative to leg sleeve 52 about an axis 91 extending through mount 88. Mount 88 includes a post 92 arranged to extend through throat 74 and a leveler retainer 94 coupled to post 92 and located in upper chamber 70 to block removal of post 92 from throat 74 through downwardly opening lower chamber 72.

As suggested in FIG. 7, guide bumper 11 is configured, sized, and arranged to provide means for normally separating the foot 80 associated with one leg 38 of a first chair 14 from an adjacent leg 38 of an underlying chair 14' in a stack of chairs (see, e.g., FIG. 10) so as to minimize marring and scratching of leg 38 of the underlying chair 14' that might otherwise be caused by foot 80 of chair 14. Guide bumper 11 also provides first separator means for separating leg 38 of chair 14 from the adjacent leg 38 of underlying chair 14' in a stack of chairs by a distance 93 so as to minimize marring and scratching of those legs 38. By associating a guide bumper 11 with each leg 30, 32, 36, 38, means is provided for protecting the exterior surface and finish of each leg when chairs are stacked on upon another.

Figure 10:
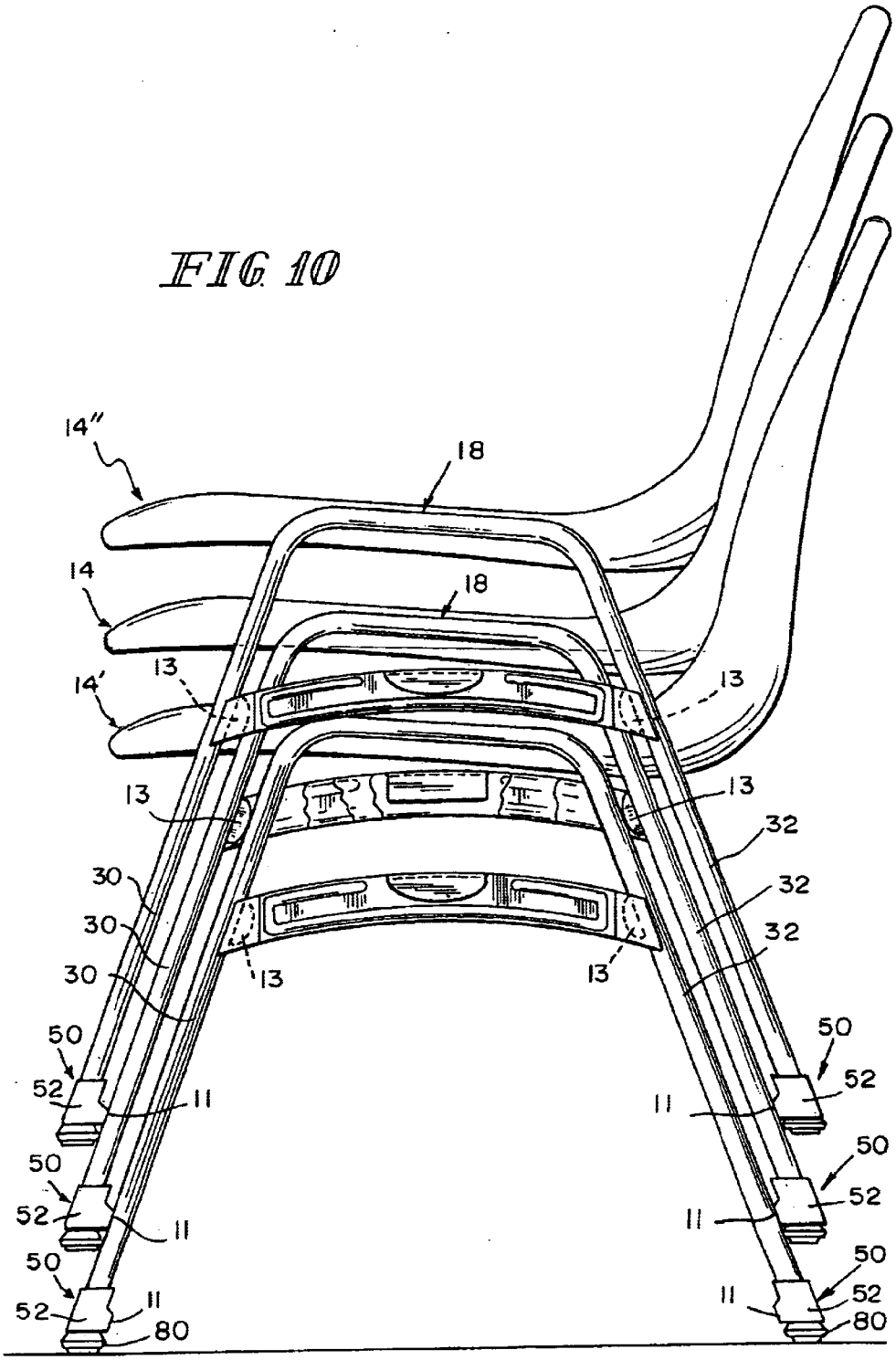
FIG. 10 is another view. of three vertically stacked chairs (see FIG. 3) showing some of the guide bumpers, stacker bumpers, guide flanges, and guide-flange receiver channels included in those chairs.

As suggested in FIGS. 3, 7, and 10 guide bumpers 11 are provided on all four chair legs 30, 32, 36, and 38 and arranged to maintain adjacent or companion pairs of legs on adjacent chairs (e.g., chairs 14" and 14 or 14 and 14') in a stack of chairs in spaced-apart parallel relation to one another. Stacker bumpers 13 are also provided on all four chair legs 30, 32, 36, and 38 and cooperate with guide bumpers 11 to maintain those adjacent or companion pairs of legs in spaced-apart parallel relation to one another upon placement of chairs in a stack. As suggested in FIGS. 3 and 10, guide bumpers 11, stacker bumpers 13, and legs 30, 32, 36, and 38 are configured, arranged, and oriented to retain a stack of chairs 14", 14, and 14' in a truly vertical orientation represented by four vertical phantom lines 100 in FIG. 3.

Figure 8:
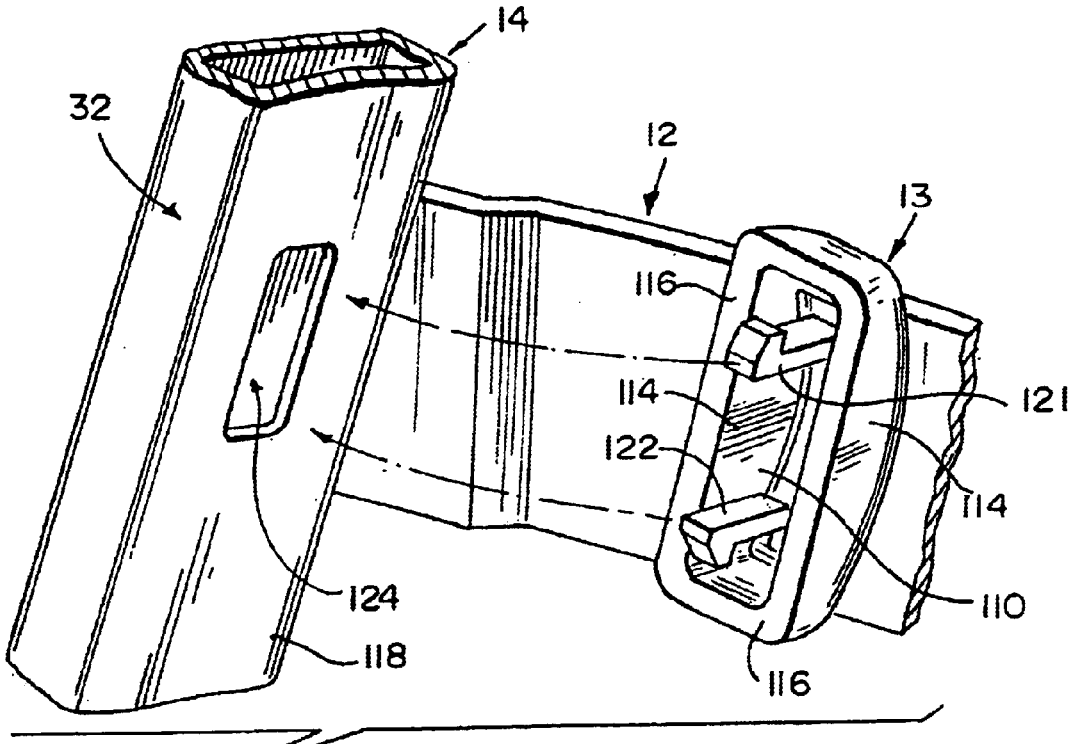
FIG. 8 is an enlarged perspective view showing a stacker bumper before it is mounted on a chair leg.
Figure 9:
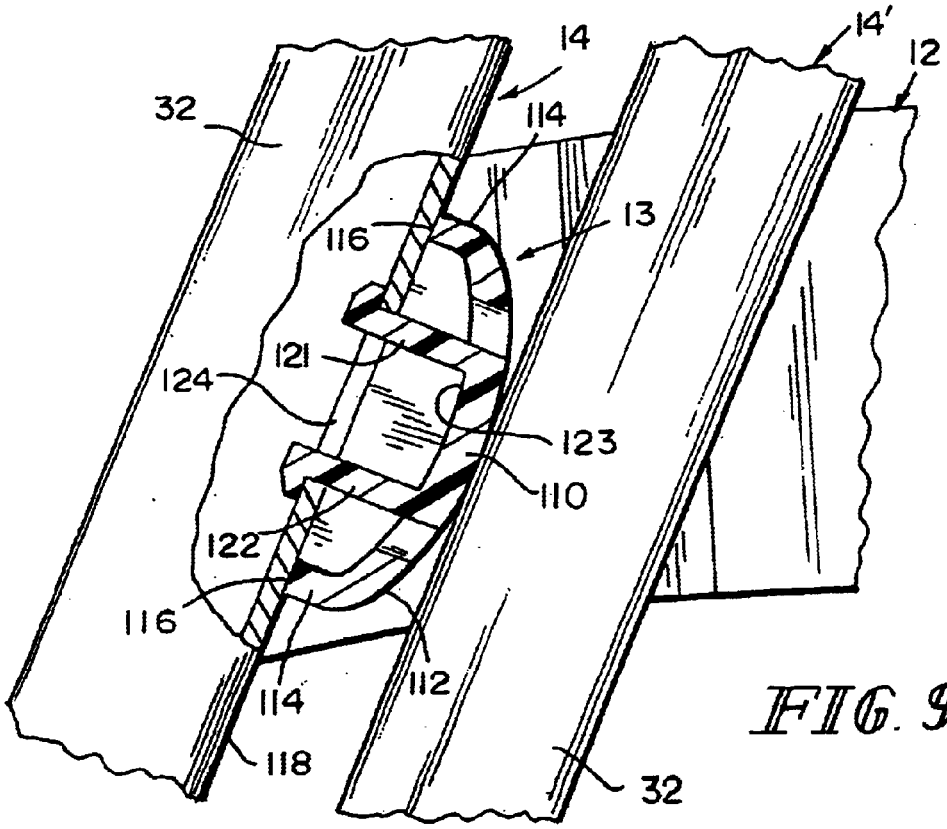
FIG. 9 is a view similar to FIG. 8 showing the stacker bumper (in section) of FIG. 8 after it has been mounted on the chair leg.

Stacker bumper 13 includes a leg pad 110 adapted to engage the adjacent leg 32 ofan underlying chair 14' as suggested in FIGS. 8 and 9. Leg pad 110 includes a convex, curved exterior surface 112 in the illustrated embodiment. Stacker bumper 13 also includes an endless side wall 114 appended to leg pad 110 and configured to include a rim 116 adapted to engage exterior wall 118 of leg 32 as suggested in FIG. 9 when stacker bumper 13 is mounted on that leg 32.

Stacker bumper 13 further includes first and second pad retainers 121, 122. These pad retainers 121, 122 are each cantilevered to an interior surface 123 of leg pad 110 and arranged to extend into a slot 124 (or other opening or openings) formed in exterior wall 118. Pad retainers 121, 122 engage portions of leg 32 to retain leg pad 110 in a fixed position relative to leg 32. Each pad retainer 121, 122 includes a bendable leg and a retainer lug coupled to a distal end of the bendable leg as shown, for example, in FIGS. 8 and 9.

Each of legs 30, 32, 36, and 38 is made of a first material (e.g., metal) and each of guide bumpers 11 and stacker bumpers 13 is made of a softer second material (e.g., plastics material). As suggested in FIGS. 8 and 9, each stacker bumper 13 is arranged to lie adjacent to one of the first and second cross bars 12 and 16.

What is claimed is:

1. A chair comprising a seat, a seat frame coupled to, the seat and configured to include legs extending downwardly below the seat, and a leg cap associated with a first of the legs, the leg cap including a leg sleeve formed to include a leg receiver, a lower end of the first of the legs extending into the leg receiver to couple the leg cap to that lower end, the leg cap further including a guide bumper coupled to the leg sleeve and arranged to lie in spaced-apart relation to the lower end of the first of the legs toprovide first separator means for separating the first of the legs from an adjacent leg of an underlying chair located under the seat and arranged to support the seat frame in a stacked position above the underlying chair so as to minimize marring and scratching of the first of the legs and the adjacent leg wherein the guide bumper includes a leg pad adapted to engage the adjacent leg of the underlying chair and a first pad support coupled to the leg sleeve and to the leg pad and arranged to hold the leg pad in a fixed, spaced-apart position relative to the leg sleeve to define an open space there between.

2. The chair of claim 1, wherein the first pad support is arranged to lie in perpendicular relation to the leg pad.

3. The chair of claim 1, wherein the guide bumper further includes a second pad support coupled to the leg sleeve and to the leg pad.

4. The chair of claim 1, further comprising an anchor plate located in the leg receiver and a floor engager coupled to the anchor plate and adapted to engage a floor underlying the anchor plate to support the seat in a position above the floor.

5. The chair of claim 4, wherein the lower end of the first of the legs is arranged to abut the anchor plate.

6. The chair of claim 5, wherein the anchor plate is formed to include a throat, the floor engager extends through the throat and includes a retainer arranged to lie in a space formed in the lower end of the first of the legs and to abut the anchor plate to block decoupling of the floor engager from the anchor plate.

7. The chair of claim 1, further comprising an anchor plate coupled to the leg sleeve, a foot associated with the first of the legs and formed to include a socket, and a foot leveler including a mount retained on the anchor plate and a ball coupled to the mount and mounted for movement in the socket to allow movement of the foot relative to the leg sleeve about an axis extending through the mount.

8. The chair of claim 7, wherein the guide bumper is configured to provide means for normally separating the foot associated with the first of the legs from the adjacent leg of the underlying chair.

9. The chair of claim 7, wherein an upper portion of the leg sleeve and the anchor plate cooperate to define an upper chamber defining the leg receiver and receiving the lower end of the first of the legs and wherein a lower portion of the leg sleeve and the anchor plate cooperate to define a lower chamber opening toward the foot leveler.

10. The chair of claim 9, wherein the anchor plate is formed to include a throat and the mount includes a post that extends through the throat and a leveler retainer coupled to the post and located in the upper chamber to block removal of the post from the throat through the lower chamber.

11. The chair of claim 1, further comprising a stacker bumper coupled to an upper end of the first of the legs and positioned to lie in spaced-apart relation to the guide bumper and wherein the stacker bumper is arranged to provide second separator means for separating the first of the legs from the adjacent leg of the underlying chair located under the seat to assist in supporting the seat frame in the stacked position so as to minimize marring and scratching of the first of the legs and the adjacent leg.

12. The chair of claim 11, wherein the second separator means cooperates with the first separator means to maintain the first of the legs and the adjacent leg in spaced-apart parallel relation to one another upon placement of the seat frame in the stacked position relative to the underlying chair.

13. The chair of claim 11, wherein the stacker bumper includes a leg pad adapted to engage the adjacent leg of the underlying chair and a first pad retainer coupled to the leg pad and to the upper end of the first of the legs to hold the leg pad of the stacker bumper in a fixed position relative to the upper end of the first of the legs.

14. A chair comprising a seat, a seat frame coupled to the seat and configured to include legs extending downwardly below the seat, a leg cap associated with a first of the legs, the leg cap including a leg sleeve formed to include a leg receiver, a lower end of the first of the legs extending into the leg receiver to couple the leg cap to that lower end, the leg cap further including a guide bumper coupled to the leg sleeve and arranged to lie in spaced-apart relation to the lower end of the first of the legs to provide first separator means for separating the first of the legs from an adjacent leg of an underlying chair located under the seat and arranged to support the seat frame in a stacked position above the underlying chair so as to minimize marring and scratching of the first of the legs and the adjactent leg, wherein the guide bumper includes a leg pad adapted to engage the adjacent leg of the underlying chair and a first pad support coupled to the leg sleeve and to the leg pad and arranged to hold the leg pad in a fixed, spaced-apart position relative to the leg sleeve, wherein the guide bumper further includes a second pad support coupled to the leg sleeve and to the leg pad, and wherein the first and second support pads are arranged to lie in spaced-apart parallel relation to one another.

15. A chair comprising a seat, a seat frame coupled to the seat and configured to include legs extending downwardly below the seat, a leg cap associated with a first of the legs, the leg cap including a leg sleeve formed to include a leg receiver, a lower end of the first of the legs extending into the leg receiver to couple the leg cap to that lower end, the leg cap further including a guide bumper coupled to the leg sleeve and arranged to lie in spaced-apart relation to the lower end of the first of the legs to provide first separator means for separating the first of the legs from an adjacent leg of an underlying chair located under the seat and arranged to support the seat frame in a stacked position above the underlying chair so as to minimize marring and scratching of the first of the legs and the adjacent leg, wherein the guide bumper includes a leg pad adapted to engage the adjacent leg of the underlying chair and a first pad support coupled to the leg sleeve and to the leg pad and arranged to hold the leg pad in a fixed, spaced-apart position relative to the leg sleeve, wherein the guide bumper further includes a second pad support coupled to the leg sleeve and to the leg pad, and wherein the first support pad is coupled to a first end of the leg pad and the second support pad is coupled to an opposite second end of the leg pad.

16. A chair comprising a seat, a seat frame coupled to the seat and configured to include legs extending downwardly below the seat, a legcap associated with a first of the legs, the leg cap including a leg sleeve formed to include a leg receiver, a lower end of the first of the legs extending into the leg receiver to couple the leg cap to that lower end, the leg cap further including a guide bumper coupled to the leg sleeve and arranged to lie in spaced-apart relation to the lower end of the first of the legs to provide first separator means for separating the first of the legs from an adjacent leg of an underlying chair located under the seat and arranged to support the seat frame in a stacked position above the underlying chair so as to minimize marring and scratching of the first of the legs and the adjacent leg, wherein the guide bumper includes a leg pad adapted to engage the adjacent leg of the underlying chair and a first pad support coupled to the leg sleeve and to the leg pad and arranged to hold the leg pad in a fixed, spaced-apart position relative to the leg sleeve, wherein the guide bumper further includes a second pad support coupled to the leg sleeve and to the leg pad, and wherein the guide bumper further includes a floor coupled to the leg pad and to the first and second support pads.

17. A chair comprising a seat, seat frame coupled to the seat and configured to include legs extending downwardly below the seat, a leg cap associated with a first of the legs, the leg cap including a leg sleeve fonned to include a leg receiver, a lower end of the first of the legs extending into the leg receiver to couple the leg cap to that lower end, the leg cap further including a guide bumper coupled to the leg sleeve and arranged to lie in spaced apart relation to the lower end of the first of the legs to provide first separator means for separating the first of the legs from an adjacent leg of an underlying chair located under the seat and arranged to support the seat frame in a stacked position above the underlying chair so as to minimize marring and scratching of the first of the legs and the adjacent leg, and wherein the guide bumper has a U-shaped cross section.

18. A chair comprising a seat a seat frame coupled to the seat and configured to include legs extending downwardly below the seat, a leg cap associated with a first of the legs, the leg cap including a leg sleeve formed to include a leg receiver, a lower end of the first of the legs extending into the leg receiver to couple the leg cap to that lower end, the leg cap further including a guide bumper coupled to the leg sleeve and arranged to lie in spaced-apart relation to the lower end of the first of the legs to provide first separator means for separating the first of the legs from an adjacent leg of an underlying chair located under the seat and arranged to support the seat frame in a stacked position above the underlying chair so as to minimize marring and scratching of the first of the legs and the adjacent leg, further comprising a stacker bumper coupled to an upper end of the first of the legs and positioned to lie in spaced-apart relation to the guide bumper and wherein the stack bumper is arranged to provide second separator means for separating the first of the legs from the adjacent leg of the underlying chair located under the seat to assist in supporting the seat frame in the stacked position so as to minimize marring and scratching of the first of the legs and the adjacent leg, and wherein the upper end of the first of the legs is formed to include a slot and the stack bumper includes a leg pad adapted to engage the adjacent leg of the underlying chair and a first pad retainer cantilevered to the leg pad and arranged to extend into the slot and engage one portion of the upper end of the first of the legs to retain the leg pad in the fixed position.

19. The chair of claim 18 wherein the stacker bumper further includes a second pad retainer cantilevered to the leg pad and arranged to lie in spaced-apart relation to the first pad retainer and to extend into the slot and engage another portion of the upper end of the first of the legs to retain the leg pad in the fixed position.

20. A kit of parts including a leg cap including a leg sleeve formed to include a leg receiver and a guide bumper coupled to the leg sleeve wherein the guide bumper includes a leg pad and a first pad support coupled to the leg sleeve and to the leg pad and arranged to hold the leg pad in a fixed, spaced-apart position relative to the leg sleeve to define an open space there between, and a stacker bumper including a leg pad and a first pad retainer shaped for coupling to a chair leg, cantilevered to the leg pad and arranged to extend away from the leg pad.

21. The kit of claim 20 wherein the stacker bumper leg pad includes a convex curved exterior surface.

22. The kit of claim 20 wherein the first pad retainer includes a bendable leg and a retainer lug coupled to a distal end of the bendable leg.

23. The kit of claim 20 further including a second pad retainer shaped for coupling to a chair leg, cantilevered to the leg pad, arranged to lie in spaced-apart relation to the first pad retainer and arranged to extend away from the leg pad.

* * * * *